US009297568B1

(12) United States Patent
Thompson

(10) Patent No.: US 9,297,568 B1
(45) Date of Patent: Mar. 29, 2016

(54) COOLER WITH COLLAPSIBLE CHAIR STORAGE

(71) Applicant: Geoffrey Thompson, Maumelle, AR (US)

(72) Inventor: Geoffrey Thompson, Maumelle, AR (US)

( * ) Notice: Subject to any disclaimer, the term of this patent is extended or adjusted under 35 U.S.C. 154(b) by 288 days.

(21) Appl. No.: 14/014,814

(22) Filed: Aug. 30, 2013

Related U.S. Application Data

(60) Provisional application No. 61/695,904, filed on Aug. 31, 2012.

(51) Int. Cl.
*F25D 3/08* (2006.01)

(52) U.S. Cl.
CPC ..... *F25D 3/08* (2013.01)

(58) Field of Classification Search
CPC F25D 3/08; F25D 2331/804; F25D 2331/809
USPC ..... 62/331, 457.1, 457.7
See application file for complete search history.

(56) References Cited

U.S. PATENT DOCUMENTS

| | | | | |
|---|---|---|---|---|
| 4,541,539 | A | 9/1985 | Matthews | |
| 5,159,777 | A * | 11/1992 | Gonzalez | A01K 97/08 280/47.19 |
| 5,269,157 | A | 12/1993 | Ciminelli et al. | |
| 5,464,237 | A * | 11/1995 | Saporiti | B62B 1/20 188/6 |
| 5,480,170 | A | 1/1996 | Kaiser, II | |
| 6,076,298 | A | 6/2000 | Teel | |
| 6,131,925 | A | 10/2000 | Weldon | |
| 6,533,298 | B2 | 3/2003 | Sims | |
| 6,796,319 | B1 * | 9/2004 | Patarra | A45B 11/00 108/138 |
| 7,163,262 | B2 * | 1/2007 | Anglin | A47C 4/04 297/184.15 |
| 7,309,106 | B2 | 12/2007 | Stallman | |
| 7,475,889 | B2 | 1/2009 | Marmah et al. | |
| 7,963,530 | B1 | 6/2011 | Garcia | |
| 8,631,665 | B1 * | 1/2014 | DeClementi | F25D 7/00 415/213.1 |
| 2007/0108248 | A1 * | 5/2007 | Hoffmeier | A45C 5/06 224/650 |
| 2008/0179847 | A1 | 7/2008 | DeFrancia | |

* cited by examiner

*Primary Examiner* — Melvin Jones

(57) ABSTRACT

A cooler is presented with integrated vertical storage tubes that are sized to receive folding camp chairs for storage and ease of transport. When a desired location is reached, the camp chairs may be removed for use, and cup holder inserts may then be placed into the tubes to convert the tubes to cup holders or closed storage for additional items. The cooler may also include a storage box attached to the lid or brackets to receive additional camp chairs in a horizontal configuration.

13 Claims, 2 Drawing Sheets

COOLER WITH COLLAPSIBLE CHAIR STORAGE

CROSS-REFERENCE TO RELATED APPLICATIONS

This application claims the benefit of U.S. provisional patent application No. 61/695,904, entitled "Cooler with Collapsible Chair Storage," filed on Aug. 31, 2012. Such application is incorporated herein by reference in its entirety.

STATEMENT REGARDING FEDERALLY SPONSORED RESEARCH OR DEVELOPMENT

Not applicable.

BACKGROUND OF THE INVENTION

Insulated coolers for the storage of beverages and foods are well known in the art. Such coolers are manufactured in a number of different sizes, shapes, and varying thicknesses of insulation. Many today are formed of plastic, but those with metal sides are also known in the art. These coolers are popularly used for camping, boating, sporting events, outdoor concerts, and many other recreational and leisure activities. Leading manufacturers of such coolers include the Coleman Company, Newell Rubbermaid, and Igloo Products Corp.

For many of the activities for which consumers purchase insulated plastic coolers, it is also desirable to bring portable chairs. Portable chairs typically fold up in some manner for convenience of carrying and storage. While traditional folding chairs simply fold flat, a popular type of "camp" chair today consists of a metal frame that folds up into a compact, generally cylindrical form. The seat and back of such chairs is generally formed of fabric stretched across the metal frame. These chairs often are sold with a cylindrically-shaped fabric storage case, which when equipped with a shoulder strap allows the chair to be easily carried over the shoulder of the user.

While carrying one camp chair is relatively simple, the task becomes more difficult when the user wishes to bring a cooler and several camp chairs along for a particular activity. For example, a family picnic may require an adult to carry chairs for the whole family, and also carry the insulated cooler at the same time. It may be seen them that a system easing the burden of carrying these items, which are often desired to be used together, would be highly desirable. The art includes attempts to design coolers and other portable storage devices with built-in storage for flat-folding chairs, such as taught in U.S. Pat. Nos. 7,475,889, 7,963,530, and 6,533,298. Given their popularity, it would be desirable to develop a cooler that includes convenient storage for camp chairs. It would be further desirable to developer a cooler with other features that are particularly adapted to storage and utility for the various sorts of activities to which these coolers are typically applied.

References mentioned in this background section are not admitted to be prior art with respect to the present invention.

BRIEF SUMMARY OF THE INVENTION

The present invention is directed to an insulated cooler with integrated storage for folding camp chairs. In various embodiments, the device also includes other features and accessories adapted for the typical activities in which a user typically engages when a cooler is being used. The invention not only allows the user to avoid multiple trips by providing storage for all desired items and gear, the invention may in fact be easily transported with one hand.

In one aspect according to a preferred embodiment, the invention is directed to a cooler comprising a hollow body comprising an open top, a closed bottom, two rear corners, and two front corners; a lid hingeably fitted to the body over the open body top; at least one chair tube attached to the body in a vertical configuration and comprising an open top end, wherein the chair tube is sized to receive a camp chair through the open top end of the chair tube; and a cup holder insert sized to be removably fitted within the open top end of the chair tube, wherein the cup holder insert comprises a resilient member to receive an item of various sizes.

These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENT(S)

Before the present invention is described in further detail, it should be understood that the invention is not limited to the particular embodiments described, and that the terms used in describing the particular embodiments are for the purpose of describing those particular embodiments only, and are not intended to be limiting, since the scope of the present invention will be limited only by the claims.

Figure 1:
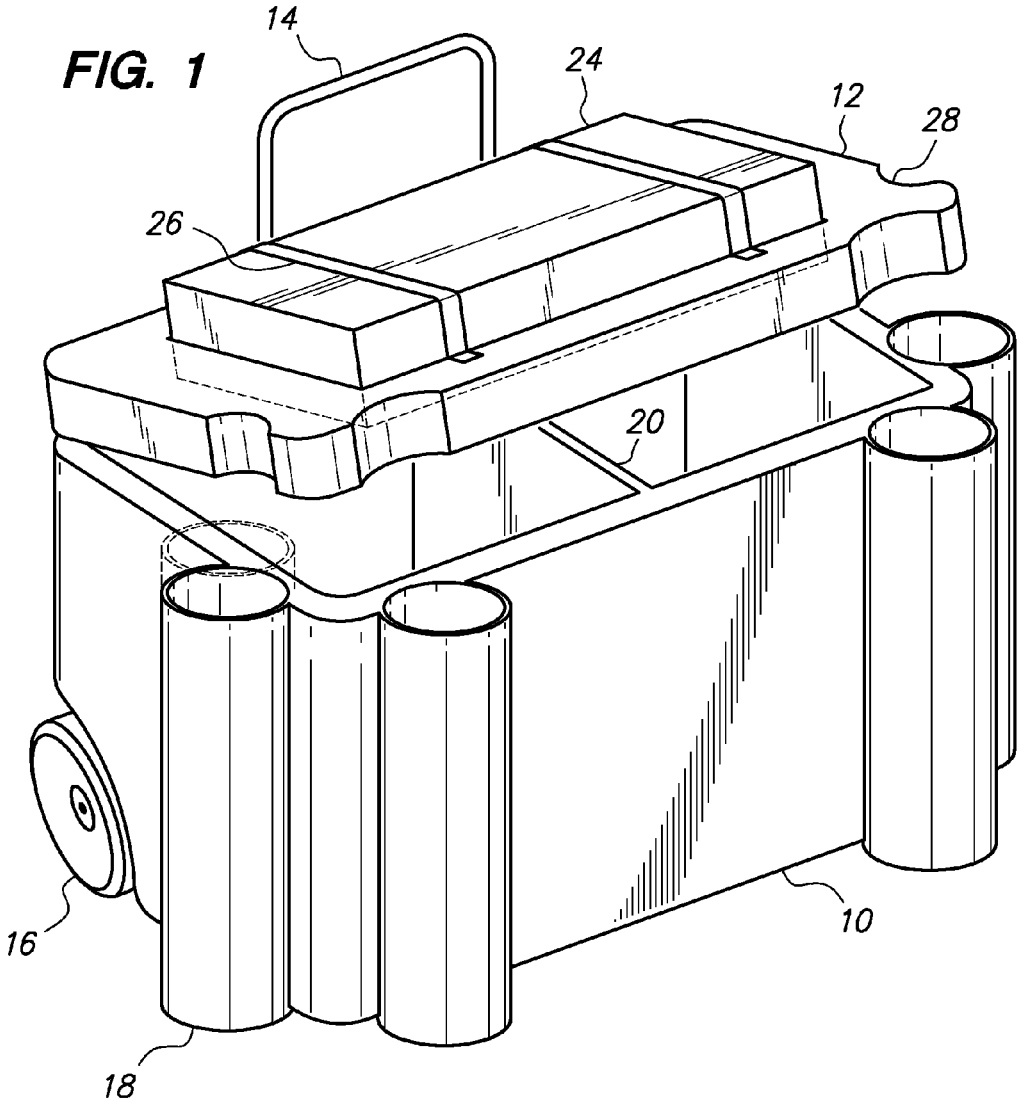
FIG. 1 is a perspective view of a first preferred embodiment of the present invention.
Figure 1A:
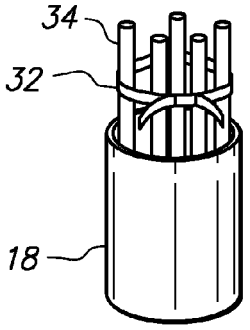
FIG. 1A is a detail, perspective view of a folded camp chair in a storage tube according to a preferred embodiment of the present invention.
Figure 1B:
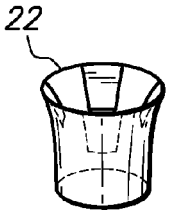
FIG. 1B is a detail, perspective view of a cup holder insert according to a preferred embodiment of the present invention.

Referring now to FIGS. 1, 1A, and 1B, a first preferred embodiment of the present invention may be described. A hollow cooler body 10 formed of lightweight plastic is configured in a general rectangular box shape, with a hinged plastic lid 12 attached to the top of body 10. The cooler could be of any different shape and size within the scope of the invention, including, for example, a square-shaped box rather than rectangular. Lid 12 is preferably hinged along the long side of the rectangular box of body 10, but in alternative embodiments could be hinged along a short side when a rectangular-box body 10 is employed as well. Wheels 16 are preferably attached at the bottom of body 10 along an axle (not shown), at the same side of body 10 where lid 12 is hinged to body 10; this arrangement reduces the likelihood of a spillage of contents from body 10 while the cooler is being transported. Preferably, wheels 16 are interchangeable so that different wheels can be attached for different applications, such as wheels with larger surface area for use on sandy beaches, or narrower wheels for hard surfaces such as asphalt and concrete. A telescoping handle 14 is also presented along the "back" side of body 10 where wheels 16 and the hinged side of lid 12 fits, allowing the user to easily pull or push the cooler along wheels 16 when moving the cooler from place to place, without the necessity of lifting.

Tubes 18 are presented vertically along one or more sides of cooler body 10. Preferably, tubes 18 are plastic pieces integrally molded into the vertical sidewalls of body 10 for increased strength, although in alternative embodiments they could be attached outside of the sidewalls of body 10 as separately molded or formed pieces. There are four tubes 18 presented in the preferred embodiment as illustrated in FIG. 1, with two tubes each being adjacent to the "front" corners of body 10, opposite the side of body 10 where lid 12 is hinged to body 10. Different numbers of tubes 18 could be employed in alternative embodiments, and the placement with respect to the sidewalls of body 10 could also be reconfigured in alternative embodiments. Each tube 18 is sized to receive a folded, collapsible camp chair of the various common varieties as known in the art. These chairs vary in size, and thus tubes 18 may vary in interior diameter from 10 cm up to 40 cm or larger. Tubes 18 are preferably closed at the bottom by a tube base (not shown) to prevent camp chairs from slipping out of tubes 18 during use, but a small hole, with or without a removable plug is preferably presented at the tube base in order to allow for drainage, such as might occur if rain collects in tubes 18 or if ice inadvertently falls into tubes 18 as ice is being deposited in cooler body 10, or as items are being removed from cooler body 10. The height of tubes 18 may vary depending upon the camp chair for which the cooler is adapted, with shorter tubes 18 being usable for smaller chairs. In the preferred embodiment, as illustrated in FIG. 1, the height of tubes 18 does not extend past the top of lid 12 when lid 12 is closed on body 10. This arrangement allows for the top of cooler 10 to be unobstructed, and therefore facilitates its use as a portable table or other horizontal surface as desired. In alternative embodiments, however, tubes 18 can extend further upward, thereby providing a more secure arrangement for folded camp chairs fitted within tubes 18. Tubes 18 preferably extend downwardly somewhat below the bottom of body 10, such that when the cooler is in the upright position, lid 12 is maintained in a level position relative to the surface upon which the cooler is placed due to being held by wheels 16 on the back side of body 10 and the lower ends of tubes 18 on the front side of body 10.

In the case of shorter tubes 18, an additional chair strap 32 may be employed for added security as illustrated in the inset of FIG. 1A. Chair strap 32 fits around folded camp chair 34, and by means of chair strap 32 the camp chair 34 is secured in position within tube 18. This arrangement is particularly desirable when a smaller cooler body 10 is employed, since in order to maintain the tubes 18 to a length that is not longer than the top of lid 12, the actual height of tubes 18 must be shorter with the smaller cooler. For ease of use, chair strap 32 preferably has a "quick-release" latch mechanism, as are well known in the art for tie-down straps.

Lid 12 preferably is shaped with circular tube cut-outs 28, positioned to match the position of the top of each of tubes 18, as illustrated in FIG. 1 for four tube cut-outs 28. In this way, tubes 18 are drawn more closely into the rectangular box shape of body 10 for compactness, while also allowing lid 12 to operate freely regardless of whether camp chairs are being stored in tubes 18. The diameter of tube cut-outs 28 is sized to match the outer diameter of tubes 18. In the preferred embodiment, tube cut-outs 28 fit closely with the outer diameter of tubes 18, thereby providing a more secure friction fit between lid 12 and body 10 when lid 12 is in the closed position.

A cup holder insert 22 according to a preferred embodiment of the present invention is illustrated in FIG. 1B. Cup holder inserts 22, preferably constructed of a rubber or synthetic rubber-like material but alternatively of lightweight plastic as are cooler body 10, lid 12, and tubes 18, are fittable within the upper ends of tubes 18. The connection may preferably be a friction fit, but various fastening means could be employed in alternative embodiments. Cup holder inserts 22 may be formed similarly to the soft rubber inserts that are used in automobile cup holders to allow cups and containers of different sizes to be securely held within a cup holder. Other resilient materials or members, such as spring-loaded leaves, may be employed to provide a secure connection with a cup, can, or bottle while also allowing different sizes of cups, cans, or bottles to be used. When fitted into position, cup holder inserts 22 are preferably sized to receive typical beverage containers, such as a 12 oz. aluminum can, or a 12 oz., 16 oz., or 500mL plastic bottle. By placing cup holder inserts 22 into tubes 18 when camp chairs are not being stored in tubes 18, the result is that tubes 18 are converted from camp chair storage to cup holders. In the illustrated embodiment of FIG. 1, the result of this operation is four cup holders for the user, but the number of cup holder inserts 22 should match the number of tubes 18 presented on the cooler.

If the cooler is to be transported without camp chairs stored in tubes 18, then cup holder inserts 22 when fitted in to place also provide the function of blocking access to tubes 18, thereby preventing the accumulation of dirt or trash within tubes 18 during use of the cooler. In addition, the placement of cup holder inserts 22 onto tubes 18 acts as a lid, transforming tubes 18 into additional storage for the user of the cooler. For example, snacks, towels, picnic items, other drinks, and the like could be placed in tube 18, and then when cup holder inserts 22 are placed into the upper end of tubes 18, those materials are securely stored and safe from spillage during transport. Because of their cylindrical shape, tubes 18 may be ideal for securely storing larger bottles, such as wine bottles. In an alternative embodiment, tubes 18 may be insulated along their interior diameter, with the open space in tubes 18 sized to snugly receive a standard 750mL wine bottle, for example. In this way, tubes 18 may serve to store and safely transport either wine bottles, or camp chairs, or some combination of these two types of items, as desired by the user. Ice, cold packs, or other cooling means could be placed within tubes 18 to keep a bottle of wine or other beverage cold within tubes 18 until removal and consumption.

Storage box 24, as shown in FIG. 1 in a first preferred embodiment of the present invention, is preferably formed of a lightweight plastic and sized to fit within a matching inset portion of lid 12. This inset results in a thinner area of lid 12, but lid 12 is still preferably solid across its top so that when storage box 24 is removed, lid 12 maintains a closed space within body 10 when lid 12 is closed.

Storage box 24 is preferably hinged or has a snap-together configuration, so that it can be opened to store various materials, including, for example, eating utensils, cups, napkins, and other picnic items. Storage box 24 is preferably held in place by box straps 26, allowing for easy removal of storage box 24 when a destination is reached. The inset of lid 12 when storage box 24 is removed allows for a recessed area in which various items may be placed during use, such that these items cannot roll away or fall because they are placed within this inset portion of lid 12.

Figure 2:
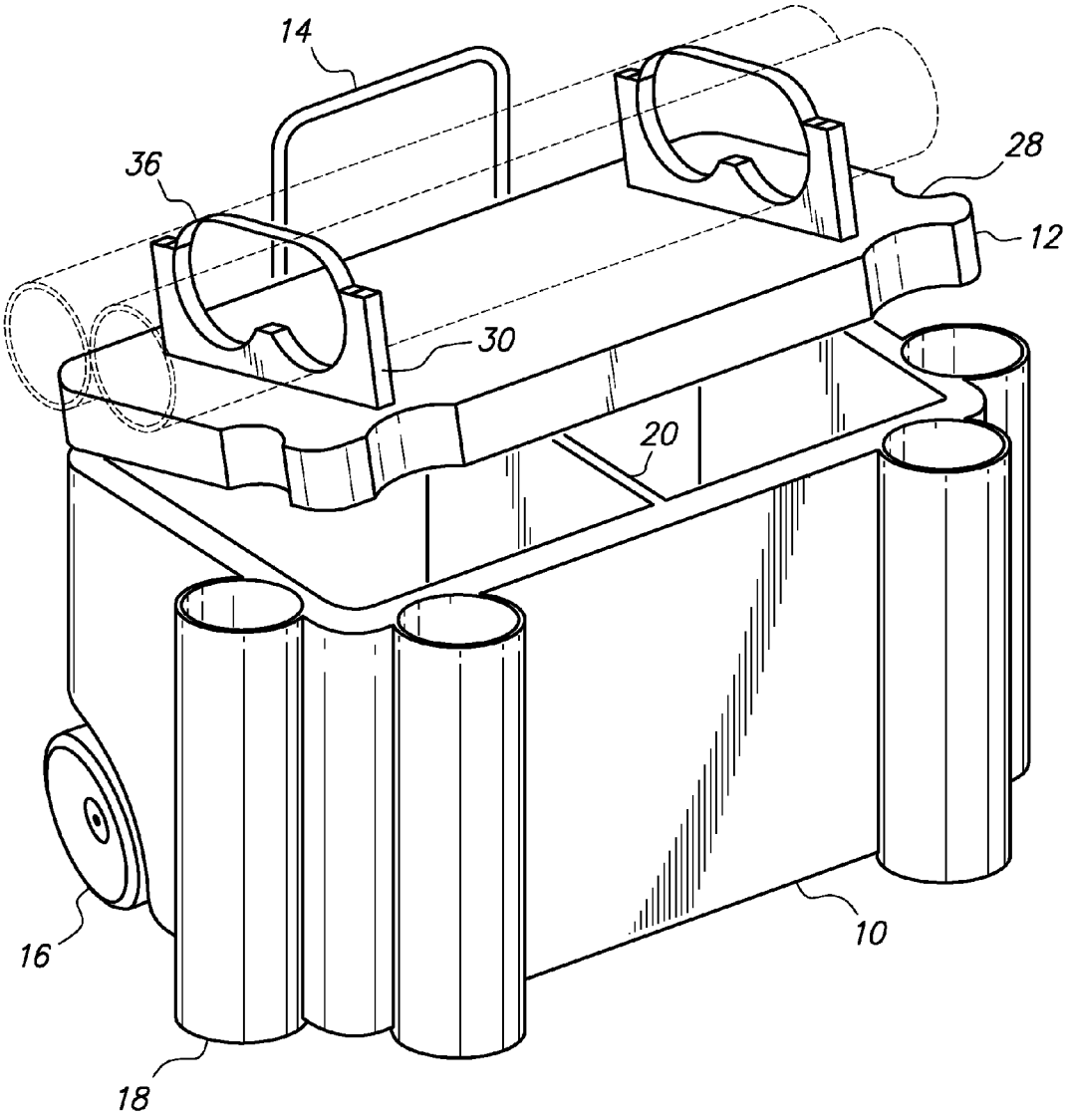
FIG. 2 is a partial cut-away perspective view of a cooler lid according to a second preferred embodiment of the present invention.

Turning now to FIG. 2, a second preferred embodiment of the invention is illustrated in which storage box 24 is replaced by chair brackets 30. In this embodiment, additional camp chairs may be positioned horizontally across lid 12 for additional camp chair storage. Chair brackets 30, as illustrated in FIG. 2, are sized to receive two additional camp chairs in their folded position, but in alternative embodiments a different number of camp chairs could be accommodated by chair brackets 30. Bracket straps 36 are employed to lash down the camp chairs once they are placed within chair brackets 30. In an alternative embodiment, the storage box of FIG. 1 and the chair brackets 30 of FIG. 2 could be combined into a single embodiment, with chair brackets 30 positioned at either end of storage box 24 on top of lid 12. In this embodiment, the user has the option of either employing storage box 24 (in which case chair brackets 30 will be blocked by storage box 24, and cannot be used), or removing storage box 24 when additional storage for more camp chairs is desired.

Referring back now to FIG. 1, cooler body 10 is preferably divided into two sections by divider 20. Divider 20 allows cooler body 10 to be used as two separate storage areas, such as, for example, storing ice in one section with food and drink that the user desires to keep cold, while the other section may be kept dry for materials such as towels or clothes. Preferably, a drain plug of the type normally used in plastic coolers may be positioned on each side of divider 20, such that either side of cooler body 10 may be used with ice or liquids, as desired. Preferably, divider 20 provides a watertight seal between the two sections of body 10. Divider 20 may be removable or may be fixed into position, and in the latter case may be integrally molded into body 10.

The structure of the preferred embodiments having now been described, their use may now be described with reference to FIGS. 1, 1A, 1B, and 2. The user loads the cooler with the various items desired before a planned activity. For example, ice, along with food and drink that the user desires to keep cold, may be placed within body 10. Divider 20 may be used such that only a portion of body 10 has ice, while the other portion on the opposite side of divider 20 remains dry to store towels, extra clothes, and the like. Once lid 12 is closed, items within the iced section of body 10 will remain cold for a substantial period based on the insulative properties of body 10 and lid 12. Camp chairs may be folded, and then vertically fitted into tubes 18. Cup holder inserts 22 may be stored within body 10, or may be attached by straps (not shown) to body 10 or some other part of the cooler for transport. The user can also place items within storage box 24 or, alternatively, use chair brackets 30 in the embodiment of FIG. 2 to store additional camp chairs in a horizontal position for transport. The user then extends telescoping handle 14, and tilts body 10 rearwardly so that its weight rests across the axle supporting wheels 16. In this manner, the user may push or pull the cooler to the desired location, optionally using only one hand. Once the desired location is reached, the user again allows the cooler to tip forward, with tubes 18 resting on the ground opposite wheels 16, and thereby preventing the cooler from rolling or moving and also maintaining lid 12 in a position that is level with respect to the surface supporting the cooler. Camp chairs from tubes 18 (and, optionally, from chair brackets 30) may be removed and set up in the sitting position, preferably near lid 12 so that lid 12 can be used as a table or other horizontal surface, as desired. Cup holder inserts 22 may then be positioned in the open top ends of storage tubes 18, such that tubes 18 now function as multi-sized cup holders for the user and the user's family and/or friends. If storage box 24 is used, it may be removed in order to provide an inset area within lid 12 where items may be placed so that they are secure from rolling off of lid 12 or falling onto the ground.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. When a Markush group or other grouping is used herein, all individual members of the group and all combinations and subcombinations possible of the group are intended to be individually included. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention, as set forth in the appended claims.

The invention claimed is:

1. A cooler, comprising:

a. a hollow body comprising an open top, a bottom, two rear corners, and two front corners;

b. at least one chair tube attached vertically to the body and comprising an open top end, wherein the chair tube is sized to receive a camp chair through the open top end of the chair tube;

c. a lid hingeably fitted to the body and pivotable over the open body top, wherein the lid comprises a tube cut-out sized to fit an outer diameter of the chair tube, wherein the tube cut-out fits closely to the chair tube outer diameter when the lid is in a closed position but allows for a camp chair to be fitted within the chair tube when the lid is in a closed position; and d. a cup holder insert sized to be removably fitted within the open top end of the chair tube, wherein the cup holder insert comprises a resilient member to receive a drinking vessel or container.

2. The cooler of claim 1, wherein the chair tube is positioned on the hollow body near a front corner of the hollow body.

3. The cooler of claim 2, wherein the cooler comprises at least two chair tubes, and wherein a chair tube is positioned adjacent to each of the two front corners of the hollow body.

4. The cooler of claim 3, wherein the cooler comprises at least four chair tubes, and wherein at least two chair tubes are positioned adjacent to each of the two front corners of the hollow body.

5. The cooler of claim 2, further comprising at least two wheels rotatably mounted adjacent to the bottom of the hollow body and extending below the hollow body, wherein each of the two wheels is mounted adjacent to one of the two rear corners of the hollow body.

6. The cooler of claim 5, wherein the tube extends downwardly below the bottom of the hollow body.

7. The cooler of claim 6, wherein the tube extends downwardly below the bottom of the hollow body to an equal extent that the at least two wheels extend below the bottom of the hollow body, whereby the lid is level with a surface upon which the cooler is placed when the lid is in the closed position and the at least two wheels and the tube are contacting the surface.

8. The cooler of claim 2, wherein the lid comprises an inset portion, and further comprising a storage box sized to be received within the inset portion.

9. The cooler of claim 8, further comprising at least one strap attached to the lid and configured to removably secure the storage box to the lid.

10. The cooler of claim 2, further comprising at one chair bracket attached to the lid, wherein the at least one chair bracket is sized and positioned to receive therethrough a camp chair.

11. The cooler of claim 10, further comprising at least one bracket strap attached to the lid or the chair bracket and configured to removably secure a camp chair to the chair bracket.

12. The cooler of claim 2, further comprising a chair strap attached to the tube, wherein the chair strap is configured to secure a camp chair within the tube.

13. The cooler of claim 2, wherein the chair tube comprises an interior diameter, and wherein the cooler further comprises an annular insulative layer adjacent to the interior diameter of the chair tube.

* * * * *